US005713281A

United States Patent [19]

Hummel et al.

[11] Patent Number: 5,713,281

[45] Date of Patent: Feb. 3, 1998

[54] DRIVE DEVICE FOR RECIPROCATING AND ROTATING A ROLLER IN A PRINTING MACHINE

[75] Inventors: Peter Hummel, Offenbach; Robert Ortner, Alzenau, both of Germany

[73] Assignee: Man Roland Druckmaschinen AG, Germany

[21] Appl. No.: 602,378

[22] Filed: Feb. 16, 1996

[30] Foreign Application Priority Data

Feb. 18, 1995 [DE] Germany ..... 195 05 625.6

[51] Int. Cl.[6] ..... B41L 25/00

[52] U.S. Cl. ..... 101/148; 101/367

[58] Field of Search ..... 101/367, 148

[56] References Cited

U.S. PATENT DOCUMENTS

| | | | |
|---|---|---|---|
| 3,002,451 | 10/1961 | Ghormley, Jr. et al. | 101/350 |
| 3,094,065 | 6/1996 | Roberts | 101/148 |
| 4,753,167 | 6/1988 | Shriver | 101/426 |
| 4,972,771 | 11/1990 | Weisgerber et al. | 101/148 |
| 5,027,704 | 7/1991 | Holl et al. | 101/148 |
| 5,249,523 | 10/1993 | Kanzler et al. | 101/350 |

FOREIGN PATENT DOCUMENTS

| | | | |
|---|---|---|---|
| 1 411 118 | 2/1971 | Germany . | |
| 36 23 590 C2 | 6/1988 | Germany . | |
| 41 40 048 A1 | 6/1993 | Germany . | |
| 0084666 | 6/1980 | Japan | 101/148 |

*Primary Examiner*—Edgar S. Burr
*Assistant Examiner*—Amanda B. Sandusky
*Attorney, Agent, or Firm*—Leydig, Voit & Mayer, Ltd.

[57] ABSTRACT

A drive device for reciprocating and rotating a roller such as a dipping roller in a dampening unit in a printing press is disclosed. The drive device includes a first driven unit and a second driven unit. The first driven unit reciprocates the driven roller along its axis whereas the second driven unit rotates the driven roller about that same axis. A coupling is provided in either the first or the second driven unit, or both, to permit the selective deactivation of one or more of the driven units to permit the drive to either rotate the roller without reciprocation, to reciprocate the roller without rotation, or to simultaneously rotate and reciprocate the roller.

21 Claims, 3 Drawing Sheets

DRIVE DEVICE FOR RECIPROCATING AND ROTATING A ROLLER IN A PRINTING MACHINE

FIELD OF THE INVENTION

The invention relates generally to printing machines such as offset printing presses, and more particularly to a drive device for reciprocating and rotating a roller such as a dipping roller in the dampening unit of an offset printing press.

BACKGROUND OF THE INVENTION

German Patent Specification 1,411,118 discloses a dampening unit having a dipping roller (dampening duct roller) for conveying dampening medium from a dampening-medium container or water fountain to a metering roller which, in turn, transfers the dampening medium further downstream to an ink applicator roller. In order to rotate the dipping roller, the dampening unit disclosed in the '118 Patent Specification is provided with a separate drive which is coupled to the dampening roller via a pull-means and a gearwheel. The drive can be manipulated to adjust the rotational speed of the dipping roller in order to control the quantity of dampening medium transferred by the dampening unit. However, the drive can only impart a rotational movement to the roller. The roller is not driven in an axial direction and an axial drive for axial distribution of the dampening medium on the dipping roller 4 is not provided in the dampening unit.

DE 3,623,590 C2 discloses a dampening unit in which the dipping roller (dampening duct roller) acquires both a rotational movement and an axial to-and-fro movement for distribution via a separate, geared motor which is coupled to the roller by a gear train. In this dampening unit, the rotary drive of the dipping roller is rigidly coupled to the axial drive in transmission terms, so that the drive speed is varied synchronously with the axial distribution.

Although the gear train of the dampening unit disclosed in DE 3,623,590 C2 can be uncoupled from the drive motor by means of a coupling, the gear train can only be uncoupled as a whole. In other words, when the drive motor and the gear train are uncoupled, both the rotational movement and the axial distribution of the roller are stopped. If, after such a stoppage occurs, the gear train is re-coupled to the drive motor, there is a risk that too much dampening medium will be conveyed onto the printing plate or into the inking unit with adverse effects on the print quality.

OBJECTS OF THE INVENTION

It is a general object of the invention to provide an improved drive device for imparting both rotational and axial movement to a roller in a printing press. More specifically, it is an object of the invention to provide such an improved drive device which drives the roller in the axial direction independently of whether or not the roller is also being rotated. It is a related object to provide an improved drive device wherein the rotational movement of the driven roller can be stopped without terminating the axial movement of that roller. It is a further related object to provide such a drive device wherein the risk of providing too much dampening medium to the inking unit is reduced by maintaining axial movement of the associated roller while the roller is not being rotated.

SUMMARY OF THE INVENTION

The present invention accomplishes these objectives and overcomes the drawbacks of the prior art by providing a device for reciprocating and rotating a roller in a printing press. In the illustrated embodiment, the inventive drive includes a drive motor for generating a driving force, means for reciprocating the roller in an axial direction, means for rotating the roller about its axis, pull means for coupling the driving force of the drive motor to the reciprocating means and to the rotating means, and, a coupling associated with the rotating means for selectively activating and deactivating the rotating means to respectively start and stop the rotation of the roller.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
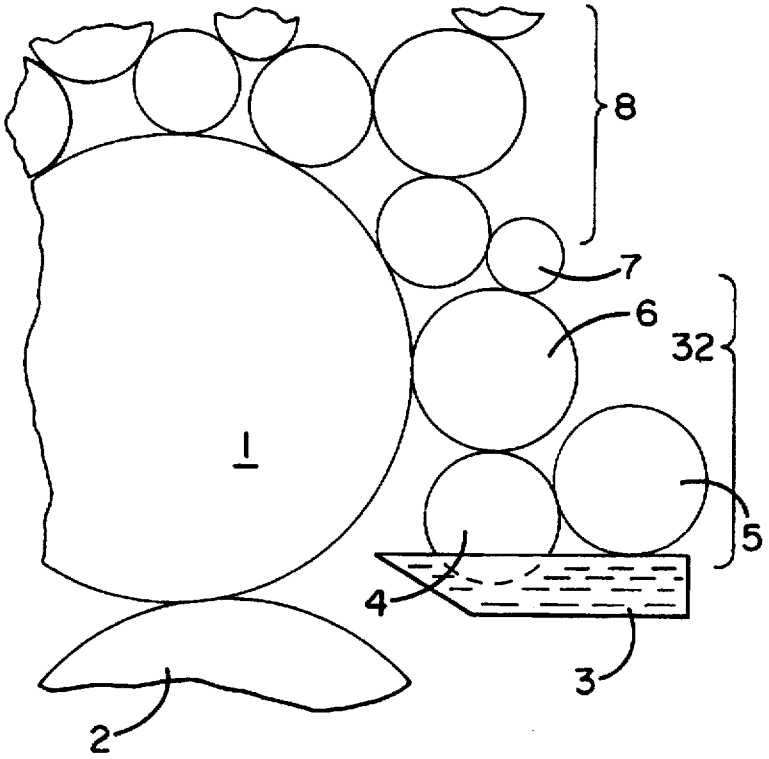
FIG. 1 is a schematic illustration of an offset printing machine.

An offset printing machine typically includes a plate cylinder 1, an adjacent rubber-blanket cylinder 2, an inking unit 8 and a dampening unit 32 as illustrated generally in FIG. 1. Typically, the dampening unit 32 comprises a dampening-medium container or water fountain 3; a roller 4 which acts as a dampening duct roller or dipping roller and which is in contact with a dampening applicator roller 6; and a metering roller 5 which is assigned to the roller 4. In order to selectively couple the dampening unit 32 to an inking unit 8, the printing machine is provided with a bridge roller 7. The bridge roller 7 can be selectively coupled or decoupled between the dampening applicator roller 6 and the inking unit 8 to selectively create a path for transferring the dampening medium from the dampening unit 32 to the inking unit 8.

Figure 2:
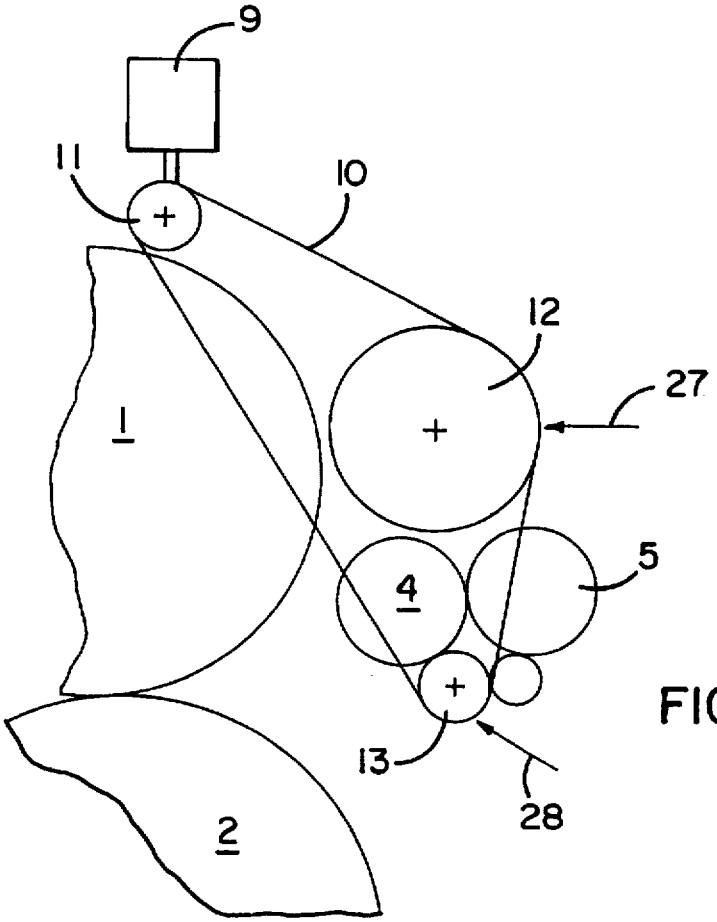
FIG. 2 is a schematic illustration of the printing machine of FIG. 1 illustrating a side view of a roller drive.

In order to drive the dampening unit 32, the dipping roller 4 of the illustrated embodiment is coupled to a drive device. In the embodiment illustrated in FIG. 2, the drive device includes a drive motor 9, such as an electric motor, mounted on the frame 14 of the printing machine. The drive motor 9 is coupled to a drive member 11 which is constructed as a V-belt pulley and which rotates in response to the driving force generated by the motor 9. A pull means 10 such as a toothed belt is disposed around drive pulley 11 and is set into rotational movement by the rotation of that pulley 11. The pull means 10 is also in engagement with two other driven members 12 and 13 such that all three driven members 11, 12, 13 rotate in the same direction in response to the driving force applied by the motor 9. In the preferred embodiment, all three driven members 11, 12, 13 comprise V-belt pulleys.

In accordance with an important aspect of the invention, the drive device is provided with a first means for reciprocating the dipping roller 4 in the axial direction, a second means for rotating the dipping roller, and a coupling associated with either the first means or the second means to permit the drive device to selectively deactivate the first or second means thereby permitting the drive device to either rotate the roller without reciprocation, to reciprocate the roller without rotation, or to simultaneously rotate and reciprocate the roller. In the illustrated embodiment the means for reciprocating the dipping roller comprises a first driven unit associated with driven member 12 and the means for rotating the dipping roller comprises a second driven unit associated with driven member 13.

To couple the driving force of the drive motor 9 to the first driven unit, the first driven unit is provided with a driven member 12. The driven member 12 is fastened on a mounting 15 fixed to the machine frame 14. The mounting 15 comprises a first rotatable shaft having driven member 12 disposed at one end and eccentric member 34 disposed on the other end. In order to convert the rotational movement of the driven member 12 into a reciprocating movement, the eccentric member 34 of the mounting 15 is rotationally connected to a link 16. As the eccentric member 34 rotates with the shaft, link 16 reciprocates back and forth in a generally vertical direction.

Figure 3:
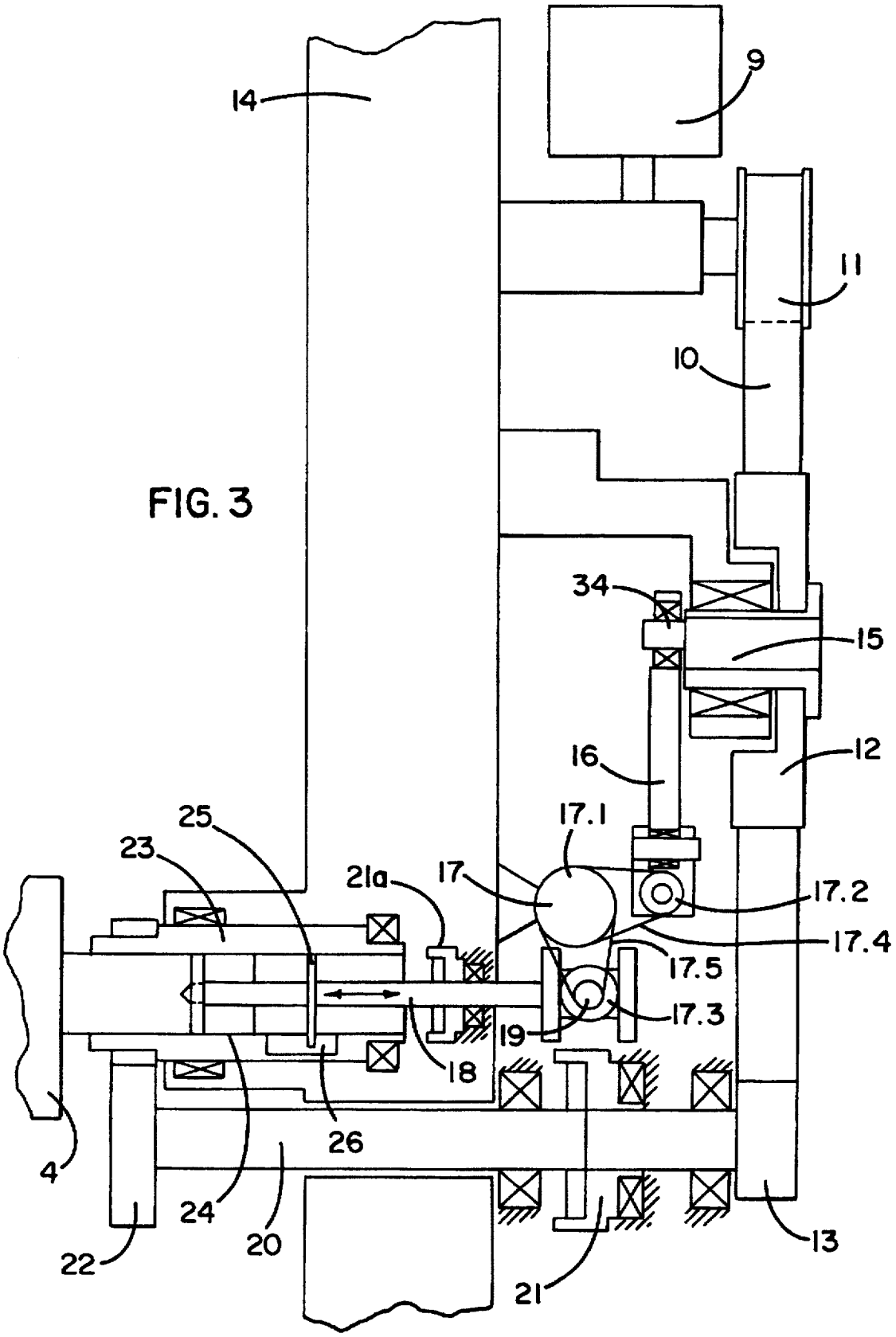
FIG. 3 is a more detailed schematic view of a drive device constructed in accordance with the teachings of the instant invention.

For the purpose of coupling the reciprocating movements of the link 16 to the dipping roller 4, the first driven unit includes an angle lever 17 fixed to the machine frame 14. As shown in FIG. 3, the angle lever 17 comprises a central rotatable drum 17.1 and two outlying rotary joints 17.2, 17.3 all of which are coupled for rotational movement via two belts 17.4, 17.5. The first rotary joint 17.2 is coupled to the link 16 to convert the reciprocating movements of the link 16 into rotational movements in a manner known in the art. Specifically, when the link 16 moves towards the first rotary joint member 17.2, the first rotary joint 17.2 rotates in a first direction whereas when the link 16 moves away from the joint 17.2, the first rotary joint 17.2 rotates in the opposite direction. A first belt 17.4 secured about the first rotary joint member 17.2 and the central drum 17.1, couples the rotational movements of the first rotary joint member 17.4 to the central drum 17.1.

A second belt 17.5 couples the rotational movements of the central drum 17.1 to the second rotary joint member 17.3. The second rotary joint member 17.3 comprises a cam roller which rotates in a cam control 19 in proportion to the movements of the central drum 17.1. The cam control 19 is fastened to an axially and radially moveable rod 18 coupled to the dipping roller 4 and, in combination with the cam roller, converts the rotational movements of the drum 17.1 into a reciprocating movement of the movable rod 18 in a manner known in the art. The movable rod 18 is disposed substantially in alignment with the dipping roller 4. Thus, the reciprocating movements of the movable rod 18 are directly reflected as reciprocating movements of the roller 4. From the foregoing, those skilled in the art will appreciate that the angle lever 17 is a ternary member in transmission terms.

In order to couple the driving force of the drive motor 9 to the second driven unit, the second driven unit is provided with a driven member 13. As shown in FIG. 3, the driven member 13 is disposed on one end of a second rotatable shaft 20, which in this case is a two-piece shaft. The two-piece shaft 20 is mounted parallel to the roller 4 in the machine frame 14 and, in accordance with an important aspect of the invention, has a coupling 21 disposed between its two parts. The coupling 21, which can be implemented pneumatically or via other equivalent means, permits the separation of the two halves of the shaft 20 in order to decouple the roller 4 from the rotational force of the drive device as explained in further detail below.

To couple the rotational force of the drive motor 9 rotating both the driven member 13 and the shaft 20 to the dipping roller 4, a gearwheel 22 is fixed on the shaft 20 at the end opposite driven member 13. The gearwheel 22 engages an externally toothed bushing or bearing 23 which is mounted for rotational movement in the machine frame 14 and which forms a sliding mounting 24 for the journal of the roller 4.

In order to transfer the rotational movements of the bushing 23 to the dipping roller 4, the bushing 23 is connected to the journal of the roller 4 or to the movable rod 18 by a pin 25. However, in order to permit axial movement of the roller 4, the pin 25 is not rigidly coupled to the bushing 23. Instead, the pin 25 is disposed in a longitudinal guide 26 formed in the bushing 23. As the dipping roller 4 is reciprocated axially, the pin 25 slides back and forth within the guide 26. On the other hand, when the gearwheel 22 applies a rotational force to the bushing 23, the contact between the inner side walls of the longitudinal guide 26 formed in the bushing 23 and the pin 25 forces the roller 4 to rotate with the bushing 23.

In operation, the drive motor 9 is actuated thereby causing the drive member 11 to rotate. The rotation of the drive member 11, in turn, causes the pull means 10 to circulate such that the first driven unit for the axial drive of the roller 4 and the second driven unit for the rotational drive of the roller 4 are set into motion at substantially the same time.

With respect to the first driven unit, in response to the rotation of the pull means 10, the driven member 12 rotates on the mounting 15 and the eccentric member 34 sets the link 16 into its generally vertical, reciprocating movements. The angle lever 17 converts the oscillating movements of the link 16 into axial drive movements of the rod 18 which, in turn, reciprocates the dipping roller 4 back and forth in the axial direction. During this reciprocation, the journal of the roller 4 is guided by the sliding mounting 24 and the longitudinal guide 26 of the bushing 23.

With respect to the second driven unit, in response to the rotation of the pull means 10, the driven member 13 rotates on the shaft 20. When the pneumatic coupling 21 connects the two halves of the shaft 20, the torque generated by the rotation of the driven member 13 is transmitted from the shaft 20 to the gearwheel 22. The interaction of the gearwheel 22 and the external toothing of the bushing 23 then causes the bushing 23 to rotate. As explained above, the rotational movement of the bushing 23 is then transmitted from the bushing 23 to the roller 4 by the pin 25.

If the operator of the printing press wishes to stop the rotational movement of the dipping roller 4, the coupling 21 is pneumatically actuated such that the two halves of the shaft 20 disconnect. This separation of the shaft 20 effectively disconnects the driven member 13 from the gear wheel 22. Thus, the part of the shaft 20 carrying the gearwheel 22 and the roller 4 stops rotating, while the part of the shaft 20 carrying the driven member 13 continues to rotate under the influence of the pull means 10.

Figure 4:
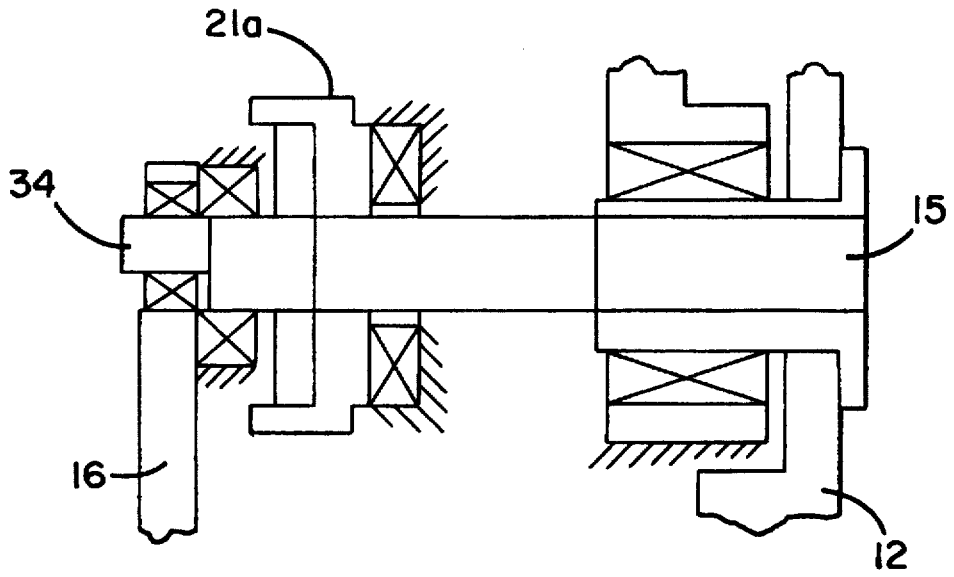
FIG. 4 is a fragmentary section of a modified embodiment of the invention.

It should be noted that the illustrated embodiment represents a preferred manner of implementing the inventive roller drive device. However, those skilled in the art will appreciate that the drive device can be implemented in other ways without departing from the scope or the spirit of the invention. For example, the pneumatic coupling 21 can be removed from the second driven unit and positioned in the first driven unit for the axial drive (preferably, by dividing the shaft of the mounting 15 into two parts and positioning a coupling **21*a* therebetween in the manner shown with respect to the second driven unit as depicted in FIG. 4) to permit the roller to be rotated without reciprocation when desired. Alternatively, both the first and second driven units can be implemented with couplings to permit the operator to selectively rotate the roller 4 without reciprocation; to reciprocate the roller 4 without rotation; or, to simultaneously rotate and reciprocate the roller 4** depending upon the operation being performed.

Those skilled in the art will further appreciate that, although the inventive drive device has been illustrated in connection with a dampening unit, the inventive drive device is suitable for driving rollers in varnishing appliances and inking units, as well as in dampening units. Moreover, those skilled in the art will further appreciate that, irrespective of the machine speed of the printing machine, a constant guidance of the medium to be conveyed, such as varnish, ink or dampening medium, is guaranteed by the inventive drive device. In addition, it will be appreciated that the axial drive of the roller is preferably maintained constant, and the radial drive of the roller takes place synchronously with the axial drive when the coupling is disposed in the coupled state.

In addition to the foregoing, those skilled in the art will readily appreciate that the drive device can be used to wash the dipping roller. Specifically, the dampening-medium container 3 can be filled with a suitable washing solution and the coupling 21 can be decoupled in the second driven unit while the axial drive is maintained to reciprocate the roller through the solution until clean. The axial drive ensures that, as a result of the reciprocation of the roller, the washing time is reduced and the roller edges are washed at the same time the roller surface is being cleaned. Consequently, use of the inventive drive device in a printing machine operating in a "wash rollers" mode, achieves an improved washing result while appreciably reducing the duration of the washing time.

Although the invention has been described in connection with certain embodiments, it will be understood that there is no intent to in any way limit the invention to those embodiments. On the contrary, the intent is to cover all alternatives, modifications and equivalents included within the spirit and scope of the invention as defined by the appended claims.

We claim:

1. A device for driving a roller in a printing press comprising:

a drive motor for generating a driving force;

means for reciprocating the roller in an axial direction in response to the driving force of the drive motor;

means for rotating the roller about its axis in response to the driving force of the drive motor;

pull means for coupling the driving force of the drive motor to the reciprocating means and to the rotating means; and, a coupling associated with the rotating means and disassociated with the reciprocating means for selectively activating and deactivating the rotating means to respectively start and stop the rotation of the roller substantially without effecting the operation of the reciprocating means.

2. A device as defined in claim 1 wherein the drive motor is coupled to a drive pulley, the drive pulley is rotated by the drive motor, and the pull means interacts with the drive pulley to couple the driving force of the drive motor to the reciprocating means and the rotating means.

3. A device as defined in claim 2 wherein the means for reciprocating the roller in an axial direction comprises a first driven unit including: (a) a first rotatable shaft, a first driven pulley operatively engaging the pull means and disposed at a first end of said first rotatable shaft for coupling the driving force of the drive motor to the first shaft, the first rotatable shaft having an eccentric member disposed at a second end opposite the first end of the shaft; (b) a link operatively connected to the eccentric member for reciprocating movement in response to the rotation of the first rotatable shaft; (c) a movable rod coupled to the roller, the movable rod being disposed in substantial alignment with the axis of the roller; and (d) means for converting the reciprocating movements of the link into reciprocating movements of the movable rod.

4. A device as defined in claim 3 further comprising a second coupling, the second coupling being associated with the first driven unit for selectively activating and deactivating the first driven unit to respectively start and stop the reciprocation of the roller substantially without effecting the operation of the rotating means.

5. A device as defines in claim 4 wherein the first shaft includes a first part and a second part with the second coupling disposed therebetween.

6. A device as defined in claim 4 wherein the means for rotating the roller about its axis comprises a second driven unit including: (a) a second rotatable shaft, a second driven pulley disposed at a first end of said second rotatable shaft and engaging the pull means for coupling the driving force of the drive motor to the second shaft; (b) a gearwheel disposed for rotation with the second shaft at a second end of the second shaft opposite the first end; (c) an externally toothed bushing in operative engagement with the gearwheel for rotating therewith, the externally toothed bushing defining a central bore for slidably receiving the journal of the roller; and (d) a pin slidably disposed within the externally toothed bushing for coupling the bushing to the journal of the roller such that the roller rotates with the bushing, and for permitting the journal to slide relative to the bushing in response to reciprocating movements of the first driven unit.

7. A device for driving a roller in a printing press comprising:

a drive motor for generating a driving force;

means for reciprocating the roller in an axial direction in response to the driving force of the drive motor;

means for rotating the roller about its axis in response to the driving force of the drive motor;

pull means for coupling the driving force of the drive motor to the reciprocating means and to the rotating means; and, a coupling associated with the reciprocating means and disassociated with the rotating means for selectively activating and deactivating the reciprocating means to respectively start and stop the axial reciprocation of the roller substantially without effecting the operation of the rotating means.

8. A device as defined in claim 7 wherein the drive motor is coupled to a drive pulley, the drive pulley is rotated by the drive motor, and the pull means interacts with the drive pulley to couple the driving force of the drive motor to the reciprocating means and the rotating means.

9. A device as defined in claim 8 wherein the means for reciprocating the roller in an axial direction comprises a first driven unit including: (a) a first rotatable shaft, a first driven pulley operatively engaging the pull means and disposed at a first end of said first rotatable shaft for coupling the driving force of the drive motor to the first shaft, the first rotatable shaft having an eccentric member disposed at a second end opposite the first end of the shaft; (b) a link operatively connected to the eccentric member for reciprocating movement in response to the rotation of the first rotatable shaft; (c) a movable rod coupled to the roller, the movable rod being disposed in substantial alignment with the axis of the roller; and (d) means for converting the reciprocating movements of the link into reciprocating movements of the movable rod.

10. A device as defines in claim 9 wherein the first shaft includes a first part and a second part with the coupling disposed therebetween.

11. A device as defined in claim 8 wherein the means for rotating the roller about its axis comprises a second driven unit including: (a) a second rotatable shaft, a second driven pulley disposed at a first end of said second rotatable shaft and engaging the pull means for coupling the driving force of the drive motor to the second shaft; (b) a gearwheel disposed for rotation with the second shaft at a second end of the second shaft opposite the first end; (c) an externally toothed bushing in operative engagement with the gearwheel for rotating therewith, the externally toothed bushing defining a central bore for slidably receiving the journal of the roller; and (d) a pin slidably disposed within the externally toothed bushing for coupling the bushing to the journal of the roller such that the roller rotates with the bushing, and for permitting the journal to slide relative to the bushing in response to reciprocating movements of the reciprocating means.

12. A device as defined in claim 11 wherein the means for reciprocating the roller in an axial direction comprises a first driven unit including: (a) a first rotatable shaft, a first driven pulley operatively engaging the pull means and disposed at a first end of said first rotatable shaft for coupling the driving force of the drive motor to the first shaft, the first rotatable shaft having an eccentric member disposed at a second end opposite the first end of the shaft; (b) a link operatively connected to the eccentric member for reciprocating movement in response to the rotation of the first rotatable shaft; (c) a movable rod coupled to the roller, the movable rod being disposed in substantial alignment with the axis of the roller; and (d) means for converting the reciprocating movements of the link into reciprocating movements of the movable rod.

13. A device for driving a roller in a printing press comprising:

a drive motor for generating a driving force; a drive pulley coupled to and rotatably driven by said drive motor;

means for reciprocating the roller in an axial direction in response to the driving force of the drive motor;

means for rotating the roller about its axis in response to the driving force of the drive motor;

pull means interactive with said drive pulley for coupling the driving force of the drive motor to the reciprocating means and to the rotating means;

said rotating means comprising a driven unit including: (a) a rotatable shaft, a second driven pulley disposed at a first end of said rotatable shaft and engaging the pull means for coupling the driving force of the drive motor to said shaft; (b) a gearwheel disposed for rotation with said shaft at a second end of said shaft opposite the first end; (c) an externally toothed bushing in operative engagement with the gearwheel for rotating therewith, the externally toothed bushing defining a central bore for slidably receiving the journal of the roller; and (d) a pin slidably disposed within the externally toothed bushing for coupling the bushing to the journal of the roller such that the roller rotates with the bushing, and for permitting the journal to slide relative to the bushing in response to reciprocating movements of the reciprocating means; and a coupling associated with the rotating means for selectively activating and deactivating the rotating means to respectively start and stop the rotation of the roller substantially without effecting the operation of the reciprocating means.

14. A device as defined in claim 13 wherein the said shaft has a first part and a second part, and the coupling associated with the rotating means is disposed in said driven unit between the first and second parts of the shaft.

15. A device as defined in claim 14 wherein the means for reciprocating the roller in an axial direction comprises an other driven unit including: (a) an other driven pulley operatively engaging the pull means and disposed at a first end of an other rotatable shaft for coupling the driving force of the drive motor to the other shaft, said other rotatable shaft having an eccentric member disposed at a second end opposite the first end of the shaft; (b) a link operatively connected to the eccentric member for reciprocating movement in response to the rotation of the other rotatable shaft; (c) a movable rod coupled to the roller, the movable rod being disposed in substantial alignment with the axis of the roller; and (d) means for converting the reciprocating movements of the link into reciprocating movements of the movable rod.

16. A device for rotating a dipping roller in a dampening unit of a printing press about its central axis and for reciprocating the dipping roller along the central axis, the device comprising:

a drive motor with an associated drive pulley;

a first driven unit including: (a) a first rotatable shaft, a first driven pulley disposed at a first end of a first rotatable shaft, the first rotatable shaft having an eccentric member disposed at a second end opposite the first end of the shaft; (b) a link operatively connected to the eccentric member for reciprocating movement in response to the rotation of the first rotatable shaft; (c) a movable rod coupled to the dipping roller, the movable rod being disposed in substantial alignment with the central axis of the dipping roller; and (d) means for converting the reciprocating movements of the link into reciprocating movements of the movable rod;

a second driven unit including: (a) a second rotatable shaft, a second driven pulley disposed at a first end of a second rotatable shaft, the second shaft having a first part and a second part; (b) a gearwheel disposed for rotation with the second shaft at a second end of the second shaft opposite the first end; (c) an externally toothed bushing in operative engagement with the gearwheel for rotating therewith, the externally toothed bushing defining a central bore for slidably receiving the journal of the dipping roller; (d) a pin slidably disposed within the externally toothed bushing for coupling the bushing to the journal of the dipping roller such that the dipping roller rotates with the bushing, and for permitting the journal to slide relative to the bushing in response to reciprocating movements of the movable rod of the first driven unit; and (e) a coupling disposed between the first and second parts of the second shaft for selectively coupling and decoupling the first and second parts to respectively start and stop the rotation of the dipping roller; and, a belt operatively engaging the drive pulley, the first driven pulley and the second driven pulley for coupling the rotational movements of the drive pulley to the first and second driven pulleys.

17. A device as defined in claim 16 further comprising a second coupling, the second coupling being associated with the first driven unit for selectively activating and deactivating the first driven unit to respectively start and stop the reciprocation of the dipping roller substantially without effecting the operation of the second driven unit.

18. A device as defines in claim 17 wherein the first shaft of the first driven unit includes a first part and a second part with the second coupling disposed therebetween.

19. A device for driving a roller in a printing press comprising:

a drive motor for generating a driving force;

a first driven unit for imparting reciprocating movement to the roller in an axial direction in response to the driving force of the drive motor;

a second driven unit for imparting rotating movement to the roller about its axis in response to the driving force of the drive motor; and one of said driven units having a coupling disassociated from the other driven unit for selectively activating and de-activating the one driven unit to respectively start and stop imparting of the respective movement to the roller without affecting the operation of the other driven unit and the imparting of movement to the roller by the other driven unit.

20. A device for driving a roller in a printing press comprising:

a drive motor for generating a driving force;

a first driven unit for imparting reciprocating movement to the roller in an axial direction in response to the driving force of the drive motor;

a second driven unit for imparting rotating movement to the roller about its axis in response to the driving force of the drive motor; and said second driven unit having a coupling disassociated from the first driven unit for selectively activating and de-activating rotational movement of said roller without affecting reciprocating movement of the roller imparted by said first driven unit.

21. A device for driving a roller in a printing press comprising:

a drive motor for generating a driving force;

a first driven unit for imparting reciprocating movement to the roller in an axial direction in response to the driving force of the drive motor;

a second driven unit for imparting rotating movement to the roller about its axis in response to the driving force of the drive motor; and said first driven unit having a coupling disassociated from said second driven unit for selectively activating and de-activating reciprocating movement imparted to said roller without affecting rotary movement imparted to said roller by said first second unit.

* * * * *